US008272314B1

(12) United States Patent
Gould

(10) Patent No.: US 8,272,314 B1
(45) Date of Patent: Sep. 25, 2012

(54) DELAYED GAS-OPERATED FIREARM

(75) Inventor: Jeffrey Hayes Gould, Bangor, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 231 days.

(21) Appl. No.: 12/838,606

(22) Filed: Jul. 19, 2010

(51) Int. Cl.
*F41A 5/18* (2006.01)

(52) U.S. Cl. ..... 89/191.01

(58) Field of Classification Search ..... 89/191.01, 89/192, 193
See application file for complete search history.

(56) References Cited

U.S. PATENT DOCUMENTS 4,553,469 A * 11/1985 Atchisson ..... 89/191.02
5,272,956 A * 12/1993 Hudson ..... 89/128

* cited by examiner

*Primary Examiner* — Stephen M Johnson
(74) *Attorney, Agent, or Firm* — Michael C. Sachs

(57) ABSTRACT

An auto-loading firearm may obtain improved firing precision by using stored energy to cycle the firearm. The firearm may be partially cycled when the trigger is pulled. The firearm may be completely cycled only when the trigger is released. Sound suppression and/or sound reduction may be obtained by limiting the amount of gas escaping the breech during extraction as well as separating the noise of the firing event from the noise of the action cycling.

15 Claims, 4 Drawing Sheets

DELAYED GAS-OPERATED FIREARM

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to firearms, and, in particular, to gas-operated, auto-loading firearms.

In auto-loading firearms, the cycle of operation is initiated by pressing the trigger. Once initiated, the entire cycle of operation is generally completed. In manually-operated firearms, on the other hand, the shooter is required to manually cycle the action of the firearm for the next round to load and be ready for firing. Manually-operated firearms are generally thought to be inherently more accurate than a similarly constructed auto-loading firearm due to the absence of recoiling parts during firing. Precision is often considered to have been traded off in favor of the convenience and speed of auto-loading.

Additionally, when an auto-loading firearm is fitted with a muzzle device for the purpose of suppressing the muzzle signature, there is often an increase in gas pressures and volumes that exit through the breech of the firearm during the automatic cycle of operation. These increases in gas pressure and volume at the breech can result in additional noise of the cycling of the action, and of gasses escaping through the breech. For these reasons, the manually-operated firearm is sometimes preferred over the auto-loading firearm, at the expense of the convenience of the auto-loading firearm.

U.S. Pat. No. 4,409,883 was issued on Oct. 18, 1983 to Edouard Nyst and is expressly incorporated by reference herein. The Nyst patent describes a rifle wherein the combustion gasses may be used to store energy in a spring and piston. When the gun user wishes the rifle's action to cycle, a latch mechanism on the forestock of the rifle may be pressed to thereby release the stored energy and cycle the rifle. The Nyst design may not be easily adapted to other weapons, such as handguns. Further, the Nyst design requires the user to operate both the trigger and a separate mechanism on the forestock.

SUMMARY OF THE INVENTION

It is an object of the invention to provide a gas-operated, auto-loading firearm wherein cycling of the firearm may be delayed and then initiated using the trigger.

In one aspect, a gas-operated, auto-loading firearm may include a barrel fixed to a receiver, a trigger disposed in the receiver and biased to a forward position, a bolt carrier disposed in the receiver, and a locking lever disposed between the trigger and the bolt carrier. A gas piston may be slidably disposed in a gas piston chamber. The gas piston may include a head and a rear surface having a protrusion thereon.

A gas bleed line may be disposed between the barrel and the gas piston chamber. A piston catch may be disposed in the receiver and may have a downward bias. A spring-loaded detent may be disposed between the piston catch and the bolt carrier. In a forward position of the bolt carrier, the spring-loaded detent may provide an upward bias to the piston catch that overcomes the downward bias.

A gas piston spring may be disposed between the gas piston head and a forward surface of the bolt carrier. A return spring may be disposed between the rear surface of the gas piston and a surface of the receiver.

In another aspect, a method may include providing a gas-operated, auto-loading firearm, activating a trigger of the firearm, compressing a gas piston spring, and then, cycling the firearm by deactivating the trigger of the firearm.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A gas-operated, auto-loading firearm may combine the convenience of an auto-loading firearm with the precision of a manually-operated firearm by using stored energy. A gas-operated, auto-loading firearm may store the energy from firing a round of ammunition and then, later, release that energy for the purpose of cycling the action of the firearm. The energy may be released as a natural function of releasing the trigger.

Operation of the firearm may be performed with the user's trigger finger through a normal application and release of the trigger. No additional training may be required because the operation of the firearm is naturally performed. The firearm may be a rifle, a shotgun, or a handgun.

Figure 1:
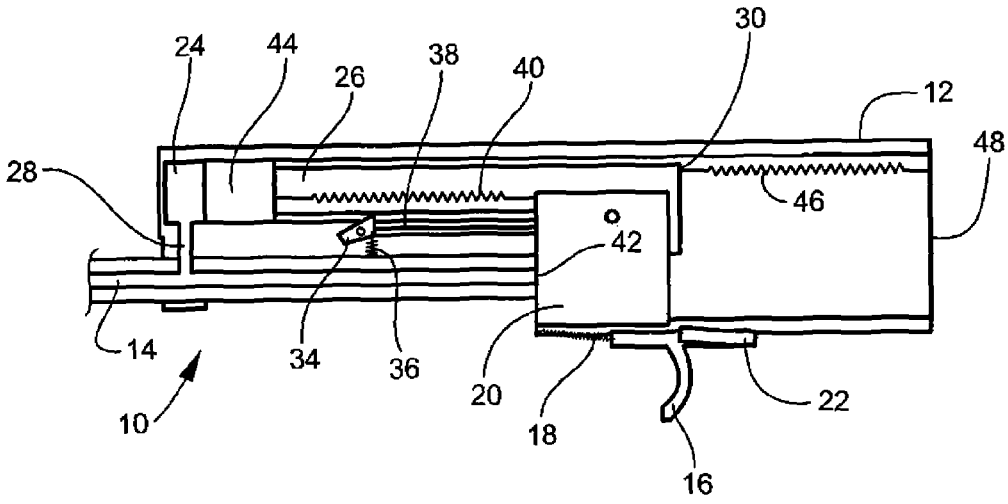
FIG. 1 is a side view of an embodiment of a gas-operated, auto-loading firearm in a ready to fire position.

FIG. 1 is a side view of an embodiment of a firearm 10 in a ready to fire position. A gas-operated, auto-loading firearm 10 may include a barrel 14 fixed to a receiver 12. A trigger 16 may be disposed in the receiver 12. Trigger 16 may be biased to the forward position shown in FIG. 1 by, for example, a trigger spring 18 disposed between trigger 16 and receiver 12.

A bolt carrier 20 may be disposed in the receiver 12. Bolt carrier 20 may carry a rotating and locking bolt or other breech locking mechanism (not shown). A locking lever 22 may be caused to move by motion of trigger 16. In the forward position of trigger 16 shown in FIG. 1, locking lever 22 may not prevent rearward movement of bolt carrier 20.

A gas piston chamber 24 may have a gas piston 26 slidably disposed therein. A gas bleed line 28 may be disposed between barrel 14 and gas piston chamber 24. Gas piston 26 may include a head 44 and a rear surface 30. Rear surface 30 may include a protrusion 32 (FIGS. 3-5) thereon. Protrusion 32 may prevent translation of bolt carrier 20 beyond rear surface 30 of gas piston 26. Protrusion 32 may also translate bolt carrier 20 forward when protrusion 32 contacts bolt carrier 20 and gas piston 26 is moving forward.

A piston catch 34 may be disposed in receiver 12. Piston catch 34 may be downwardly biased by, for example, piston catch spring 36. In FIG. 1, piston catch 34 is in an upward position. A spring-loaded detent 38 may be disposed between piston catch 34 and bolt carrier 20. In the forward position of bolt carrier 20 shown in FIG. 1, spring-loaded detent 38 may provide an upward bias to piston catch 34 that overcomes the downward bias provided by piston catch spring 36.

A gas piston spring 40 may be disposed between gas piston head 44 and a forward surface 42 of bolt carrier 20. A return spring 46 may be disposed between rear surface 30 of gas piston 26 and a surface 48 of receiver 12.

Figure 2:
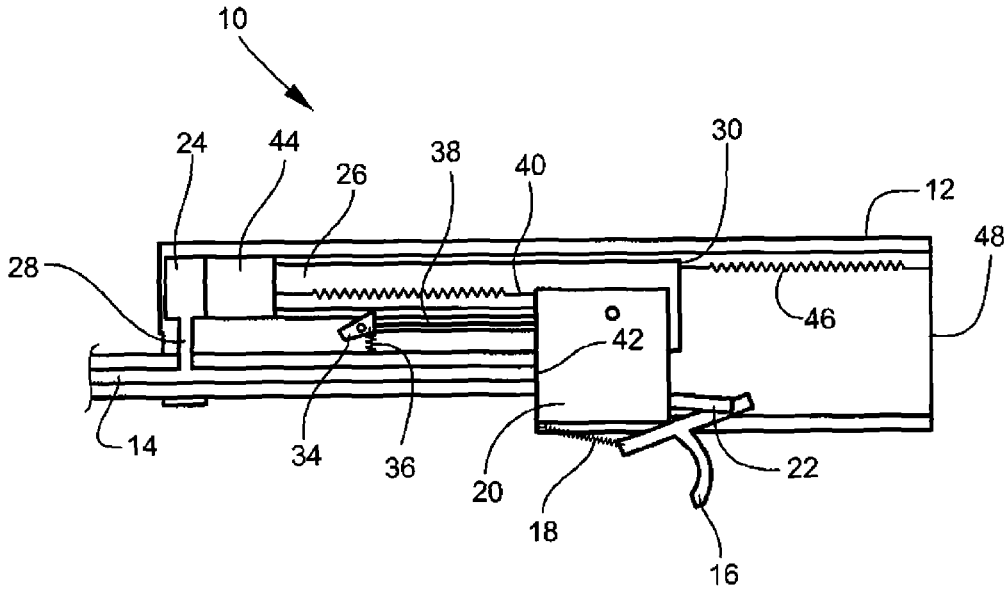
FIG. 2 is a side view of the firearm of FIG. 1 showing the trigger manipulated just prior to firing.

In FIG. 1, bolt carrier 20 is closed with a round of ammunition (not shown) chambered in barrel 14. Trigger 16 is in its forward resting position and locking lever 22 is down. Gas piston 26 is in its forward position. Bolt carrier 20 is in its forward position. As seen in FIG. 2, when trigger 16 is operated, locking lever 22 is raised to prevent bolt carrier 20 from moving rearward. Upon firing, the projectile moves down barrel 14. When the projectile passes gas bleed line 28, some portion of the propelling gasses may be bled to gas piston chamber 24.

Figure 3:
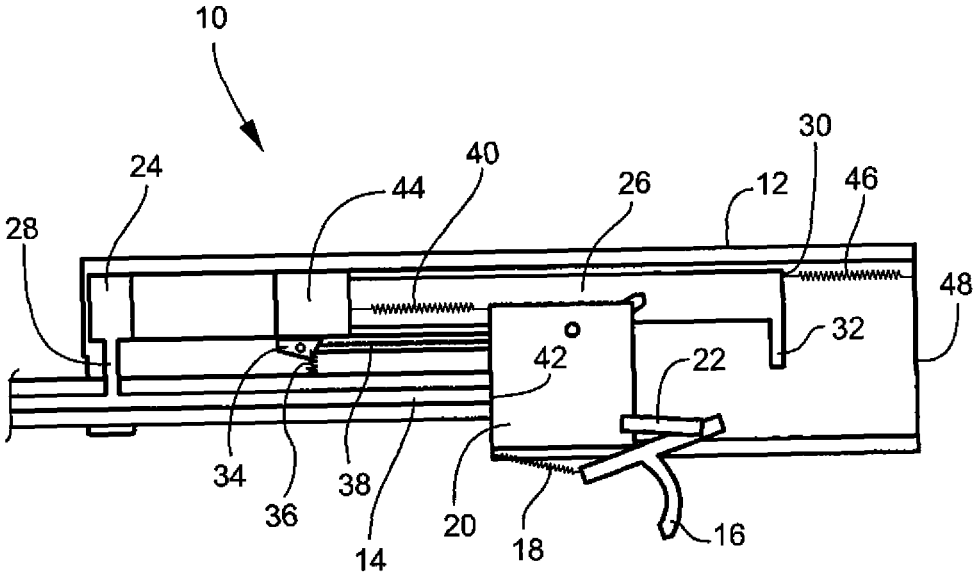
FIG. 3 is a side view of the firearm of FIG. 1 showing the combustion gasses acting on the gas piston.

As seen in FIG. 3, the propelling gasses may then act on gas piston 26 and may move gas piston 26 rearward in gas piston chamber 24. Rearward movement of gas piston 26 may compress gas piston spring 40 against forward surface 42 of bolt carrier 20 and may compress return spring 46 against surface 48 of receiver 12. Bolt carrier 20 may be restrained from rearward translation by the upward locking position of locking lever 22. Locking lever 22 may be held in place because trigger 16 may continue to be positioned rearward by the firearm user.

Figure 4:
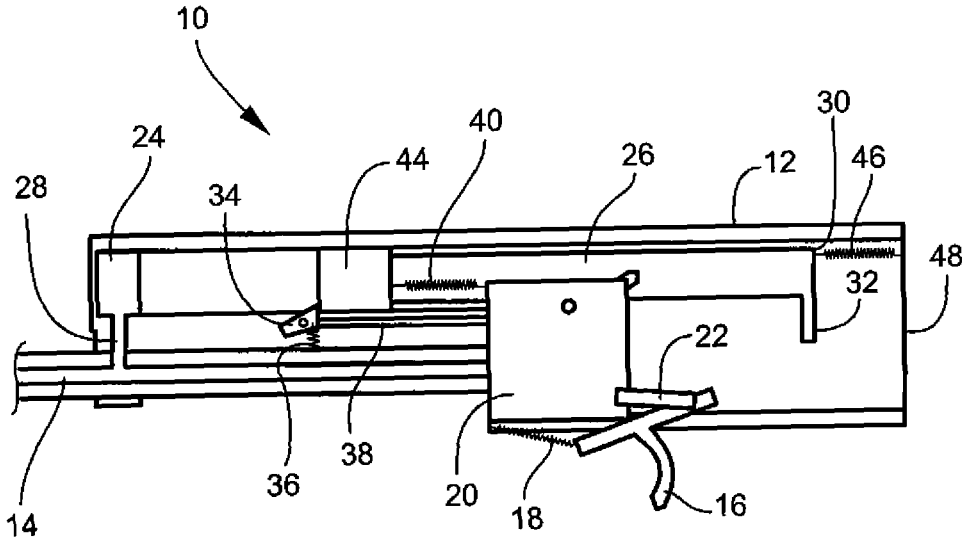
FIG. 4 is a side view of the firearm of FIG. 1 showing the gas piston locked to the rear.
Figure 5:
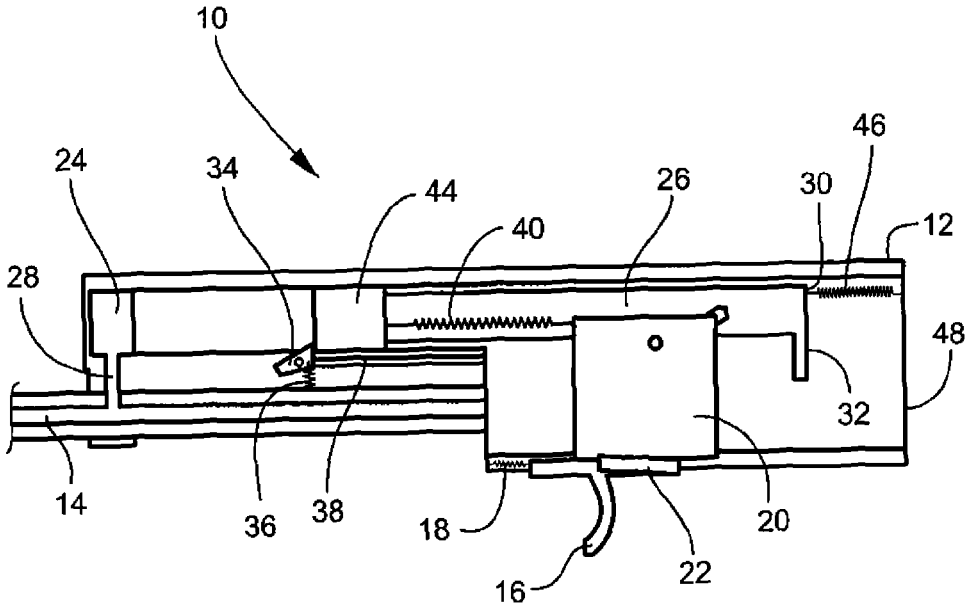
FIG. 5 is a side view of the firearm of FIG. 1 showing the bolt carrier released and moving rearward.

In FIG. 4, gas piston 26 is at full compression and has reached the end of its rearward travel. Energy from the propelling gases may be stored in compressed gas piston spring 40. Gas piston 26 may be prevented from translating forward by piston catch 34. Piston catch 34 was rotated downwardly (FIG. 3) by head 44 of piston 26 as head 44 slid over piston catch 34. When head 44 cleared piston catch 34, piston catch 34 was rotated upwardly by forward surface 42 of bolt carrier 20 acting on spring-loaded detent 38.

Firearm 10 may remain in the position shown in FIG. 4 until bolt carrier 20 is allowed to move. When the firearm user releases trigger 16, locking lever 22 may be rotated downwardly (FIG. 5), thereby freeing bolt carrier 20 to move rearward under the force of compressed gas piston spring 40 acting on forward surface 42. Piston catch 34 may remain in its upward position by continued pressure from piston head 44. Piston catch 34 may remain in its upward position even as bolt carrier 20 moves rearward. Piston catch 34 may restrain head 44 of gas piston 26, thereby allowing the stored energy of gas piston spring 40 to act against bolt carrier 20.

Rearward movement of bolt carrier 20 may partially cycle the firearm 10. Partial cycling may include unlocking the bolt (not shown), extracting and ejecting a spent cartridge case (not shown), cocking the firing components (not shown), and further compressing return spring 46. Piston catch 34 may rotate to its downward position (FIG. 6) after bolt carrier 20 has translated rearward and pressure from gas piston spring 40 has been released.

Figure 6:
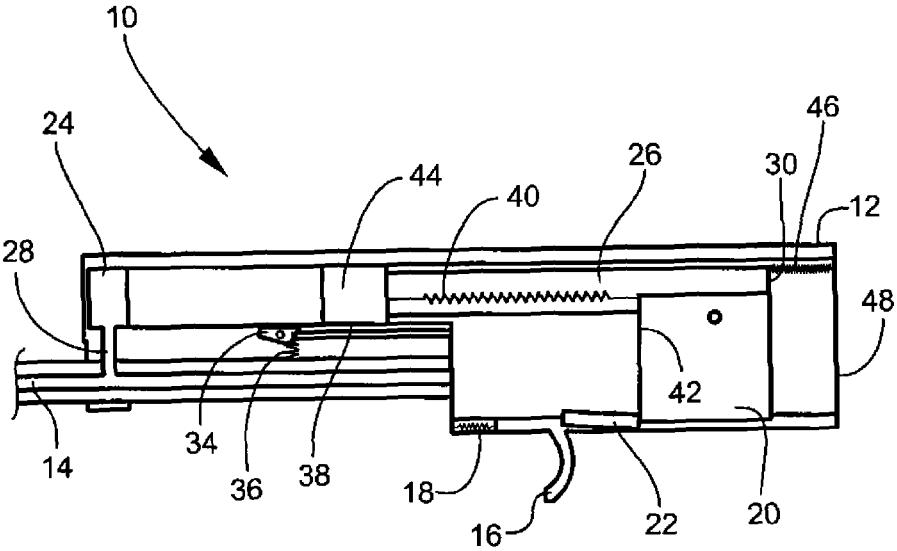
FIG. 6 is a side view of the firearm of FIG. 1 showing the bolt carrier at the end of its rearward travel.
Figure 7:
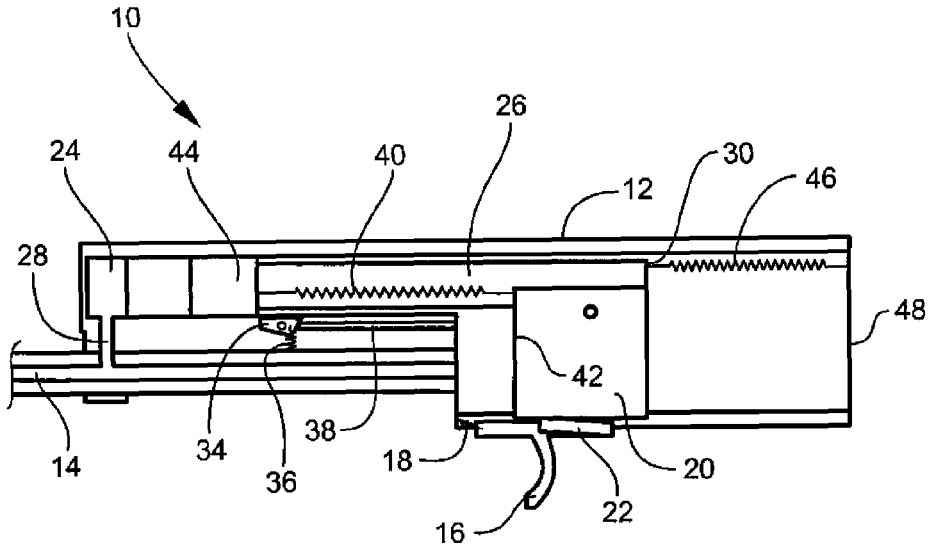
FIG. 7 is a side view of the firearm of FIG. 1 showing the bolt carrier and gas piston moving forward together.

When bolt carrier 20 reaches the rearward end of its travel, as shown in FIG. 6, return spring 46 may be compressed and protrusion 32 on rear surface 30 of gas piston 26 may be in contact with bolt carrier 20. Compressed return spring 46 may now translate gas piston 26 forward. Because of the contact of the protrusion 32 on bolt carrier 20, bolt carrier 20 may also be translated forward, as shown in FIG. 7. As bolt carrier 20 moves forward, the firearm cycle of operation may be completed. For example, the next round of ammunition may be chambered and the bolt (not shown) locked.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A gas-operated, auto-loading firearm, comprising:
- a barrel fixed to a receiver;
- a trigger disposed in the receiver and biased to a forward position;
- a bolt carrier disposed in the receiver;
- a locking lever disposed between the trigger and the bolt carrier;
- a gas piston chamber and a gas piston slidably disposed in the gas piston chamber, the gas piston including a head and a rear surface, the rear surface having a protrusion thereon; a gas bleed line between the barrel and the gas piston chamber;
- a piston catch disposed in the receiver and having a downward bias;
- a spring-loaded detent disposed between the piston catch and the bolt carrier wherein, in a forward position of the bolt carrier, the spring-loaded detent provides an upward bias to the piston catch that overcomes the downward bias;
- a gas piston spring disposed between the gas piston head and a forward surface of the bolt carrier; and
- a return spring disposed between the rear surface of the gas piston and a surface of the receiver.

2. The firearm of claim 1, wherein, in a rear position of the trigger, the locking lever prevents rearward translation of the bolt carrier and, in a forward position of the trigger, the locking lever does not prevent rearward translation of the bolt carrier.

3. The firearm of claim 2, wherein the protrusion prevents translation of the bolt carrier beyond the rear surface of the gas piston and further wherein the protrusion translates the bolt carrier forward.

4. The firearm of claim 3, wherein, in an upward position of the piston catch, the piston catch prevents forward translation of the gas piston.

5. The firearm of claim 4, further comprising a piston catch spring disposed between the piston catch and the receiver, for biasing the piston catch downwardly.

6. The firearm of claim 5, further comprising a trigger spring disposed between the trigger and the receiver, for biasing the trigger in the forward position.

7. The firearm of claim 1, wherein the firearm comprises a rifle.

8. The firearm of claim 1, wherein the firearm comprises a shotgun.

9. The firearm of claim 1, wherein the firearm comprises a handgun.

10. A gas-operated, auto-loading firearm, comprising:
- a barrel fixed to a receiver;
- a trigger disposed in the receiver and biased to a forward position;
- a bolt carrier disposed in the receiver;
- a locking lever disposed between the trigger and the bolt carrier wherein, in a rear position of the trigger, the locking lever prevents rearward translation of the bolt carrier and, in a forward position of the trigger, the locking lever does not prevent rearward translation of the bolt carrier;

a gas piston chamber and a gas piston slidably disposed in the gas piston chamber, the gas piston including a head and a rear surface, the rear surface having a protrusion thereon wherein the protrusion prevents translation of the bolt carrier beyond the rear surface of the gas piston and further wherein the protrusion translates the bolt carrier forward;

a gas bleed line between the barrel and the gas piston chamber;

a piston catch disposed in the receiver and having a downward bias wherein, in an upward position of the piston catch, the piston catch prevents forward translation of the gas piston;

a spring-loaded detent disposed between the piston catch and the bolt carrier wherein, in a forward position of the bolt carrier, the spring-loaded detent provides an upward bias to the piston catch that overcomes the downward bias;

a gas piston spring disposed between the gas piston head and a forward surface of the bolt carrier; and a return spring disposed between the rear surface of the gas piston and a surface of the receiver.

11. The firearm of claim 10, further comprising a piston catch spring disposed between the piston catch and the receiver, for biasing the piston catch downwardly.

12. The firearm of claim 11, further comprising a trigger spring disposed between the trigger and the receiver, for biasing the trigger in the forward position.

13. The firearm of claim 10, wherein the firearm comprises a rifle.

14. The firearm of claim 10, wherein the firearm comprises a shotgun.

15. The firearm of claim 10, wherein the firearm comprises a handgun.

* * * * *